US006694908B2

(12) United States Patent
Parsons

(10) Patent No.: US 6,694,908 B2
(45) Date of Patent: Feb. 24, 2004

(54) BALLAST-FREE SHIP SYSTEM

(75) Inventor: Michael G. Parsons, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 10/201,793

(22) Filed: Jul. 24, 2002

(65) Prior Publication Data

US 2003/0019413 A1 Jan. 30, 2003

Related U.S. Application Data

(60) Provisional application No. 60/307,481, filed on Jul. 24, 2001.

(51) Int. Cl.[7] ..... B63B 39/03
(52) U.S. Cl. ..... 114/125; 114/74 R
(58) Field of Search ..... 114/74 R, 125

(56) References Cited

U.S. PATENT DOCUMENTS 4,528,927 A * 7/1985 Iizuka et al. ..... 114/125
6,053,121 A 4/2000 Tamashima et al.
6,338,307 B1 1/2002 Pires

FOREIGN PATENT DOCUMENTS

FR 478 386 A 12/1915
GB 2174347 A 11/1986

* cited by examiner

*Primary Examiner*—Jesus D. Sotelo
(74) *Attorney, Agent, or Firm*—Young & Basile, P.C.

(57) ABSTRACT

An apparatus and method for changing the volume of the watertight hull of a ship in the light or no cargo condition to achieve the required ballast drafts. At least one trunk extending longitudinally from a first end at a bow of the ship to a second end at a stern of the ship. The first and second ends of the trunk connectible to the water surrounding the ship by operation of an inlet valve and an outlet valve adjacent each end. When in the light condition, or no cargo condition, the valves at each end of the trunk or trunks are moved to an opened position to reduce the volume of the watertight hull in order to achieve the desired ballast draft. While the ship is in motion, sufficient pressure differential exits between the bow and the stern of the ship to exchange the volume of water in the trunks over a period of time. Preferably, the fluid flow through the trunks exchanges the water at least approximately every hour when the ship is moving at normal speed.

20 Claims, 2 Drawing Sheets

BALLAST-FREE SHIP SYSTEM

RELATED APPLICATIONS

This application claims the benefit of provisional application No. 60/307,481 which was filed on Jul. 24, 2001.

FIELD OF THE INVENTION

The present invention relates to improvements in ballasting for ships, and more particularly, to a ballast-free system for ships.

BACKGROUND OF THE INVENTION

All ships are designed recognizing Archimedes Principle stating that the weight of a ship is balanced by the weight of the fluid displaced by the watertight hull, termed buoyancy. The approach to ballasting ships has for centuries been the addition of weight to get the ship down to the required ballast drafts forward and aft. Early vessels used solid ballast and then, with the advent of steel ships and mechanical pumps, ships moved to the much more practical water ballast stored in various ballast tanks. The water in these tanks or the residual water and sediment in empty ballast tanks is today the principal culprit for the introduction of nonindigenous aquatic species from one environment to another.

U.S. Pat. No. 6,053,121 assigned to Teekay Shipping Corporation of Nassau, Bahamas sought to reduce the crew effort and pumping power required to accomplish flow-through ballast exchange, by using piping from high pressure at the bow connected to each ballast tank to drive a flow-through ballast exchange process. On the high seas, the conventional ballast tanks are sequentially lowered to a hydrostatic balance level and then connected to the bow high pressure. The bow pressure forces flow through the tank to a low discharge at the forward bottom of the tank. After a period of flow-through, each ballast tank is isolated and pumped back full using the ballast pump.

SUMMARY OF THE INVENTION

The present invention includes a completely new approach to the ballasting of ships. By changing the entire thinking about ballasting a ship, a paradigm shift, it may be possible to virtually eliminate the potential for the introduction of nonindigenous aquatic species into the Great Lakes and other coastal waters. Ships must ballast when operating without cargo in order to provide transverse stability, provide bow submergence to prevent slamming structural damage, reduce windage for adequate maneuverability, provide propeller submergence, etc. The current ballast management method of high seas ballast exchange is generally considered to be only partially effective and alternative methods, such as mechanical separation and ultraviolet (UV) light treatment, require significant capital investment, weight, and space.

By making a complete change in thinking, a ship can also achieve its required ballast drafts by changing the volume of the watertight hull in the light (no cargo) condition; i.e., reducing the buoyancy rather than adding weight. During operation, there is a positive hull surface pressure differential between the bow and the stern regions of a ship. The external portion of the hull around the cargo carrying portion of the ship below the desired ballast waterline can be designed to include a group of structural trunks running the full length of the cargo hold. In ballast operations, these trunks can be opened to the sea with an intake opening at the bow and a discharge opening at the stern. These trunks can be flooded, reducing the buoyancy of the hull and allowing the ship to sink to its desired ballast drafts. With the positive pressure drop between the bow and the stern, these trunks can experience a low velocity flow during the entire ballast voyage. This can reduce the watertight volume and buoyancy of the hull in the ballast condition. The ship can then achieve its desired ballast drafts. With flow, the water in these trunks can always be "local" water virtually eliminating the possibility of the introduction of nonindigenous aquatic species into the Great Lakes and other coastal environments. When loading cargo, these trunks can be isolated from the sea by valves and pumped dry using current ballast pumps.

While the present invention appears reasonable and technically feasible, it is believed that ship models will confirm that this change in the overall design of new ships can actually be physically and economically feasible. The goal of the ship models will be to confirm that the ships do not transport ballast or sediments from one point to another and essentially operate ballast-free. It is believed that research using the ship models will confirm and quantify the following key technical and cost issues related to the present invention:

- establish the pressure differential and resulting flow rate through the trunks,
- establish the effect of the flow diversion through the hull on the resistance and propulsion of the ship using a combination of analyses, Computational Fluid Dynamics (CFD) computations, and model-scale towing tank experiments,
- develop a structural design for the ballast-free ship that can provide equivalent structural effectiveness at a comparable cost,
- develop details of the inlet and outlet plena, ballast piping, and ballast system controls within an overall ship and engine room arrangement,
- develop overall cargo arrangements that can provide the same grain cargo capacity as existing vessels,
- verify adequate vessel transverse stability,
- analyze ship motions at sea reflecting a higher ballast condition metacentric height $GM_T$ and a higher cargo center of gravity,
- analyze the damage survival capability relative to the current probabilistic IMO standards to verify at least equivalent safety with the longitudinally subdivided trunks, and
- estimate ship construction and operating costs to establish an economic comparison to existing ships with current ballast management options.

Full-scale verification of the present invention is not practical. A true full-scale demonstration would require new ship construction of costly ship modifications. Therefore, large self-propelled, model-scale testing in the University of Michigan Marine Hydrodynamics Laboratory will be used as the most feasible substitute for a full-scale demonstration of the present invention. With success, the present invention can provide a completely new way to design ships so that the risk of the introduction of nonindigenous aquatic species through the ballast water vector might be essentially eliminated.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
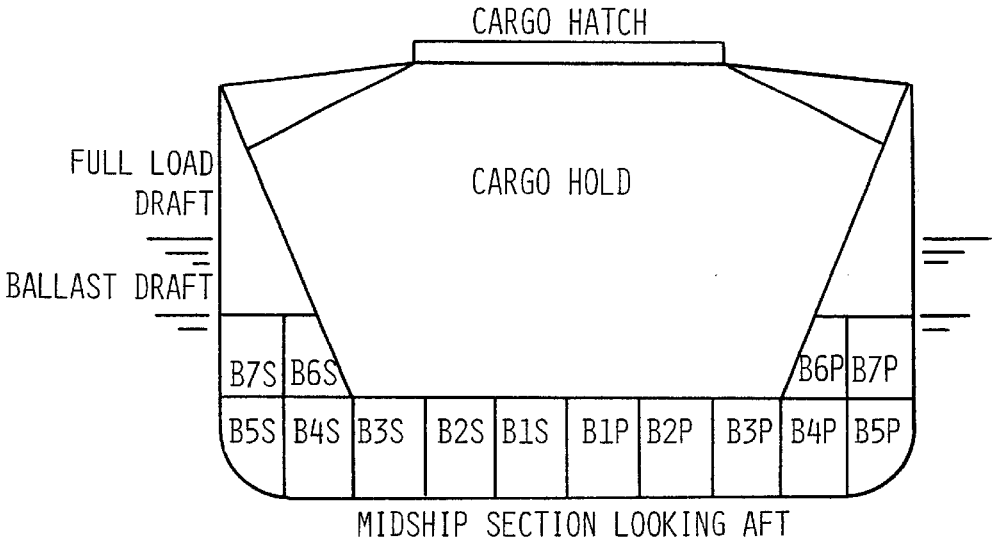
FIG. 1 is a schematic cross-section of a ballast-free seaway-size bulk carrier according to the present invention.

The problem of the introduction of nonindigenous aquatic species into the Great Lakes and coastal waters is now well recognized. For hundreds of years ships have used either solid, or later water, ballast to submerge the ship to a safe level when there is no cargo onboard. The present invention provides a completely new approach to the ballasting of ships. By changing the entire thinking about ballasting a ship, a paradigm shift, it may be possible to virtually eliminate the potential for the introduction of nonindigenous aquatic species into the Great Lakes and other coastal waters. Ships must ballast when operating without cargo in order to provide transverse stability, provide bow submergence to prevent slamming structural damage, reduce windage for adequate maneuverability, provide propeller submergence, etc. The current ballast management method of high seas ballast exchange is generally considered to be only partially effective and alternative methods, such as mechanical separation and ultraviolet (UV) light treatment, require significant capital investment, weight, and space.

All ships are designed recognizing Archimedes Principle that states that the weight of a ship is balanced by the weight of the fluid displaced by the watertight hull, termed the buoyancy. Expressing this symbolically yields, Full load weight $W_{full\ load}$=displacement of buoyancy Δ at some draft T.

$$W_{full\ load}=W_{LS}+W_{miscDWT}=\Delta(T_{full\ load})$$

where $W_{LS}$=Light Ship weight (hull structure, machinery, and outfit), $W_{cargo}$=Cargo Deadweight, $W_{miscDWT}$=miscellaneous Deadweight (fuel, water, lube oil, stores, etc.), Δ=displacement of normal hull form, a function of draft T.

The traditional approach to ballasting ships has for centuries been the addition of weight to get the ship down to the desired ballast drafts forward and aft. Expressing this symbolically then yields, $$W'=W_{LS}+W_{ballast}+W_{miscDWT}'=\Delta(T_{ballast})$$

where W'=weight of the ship in the burned out ballast condition, $W_{ballast}$=weight of ballast added to the ship, $W_{miscDWT}'$=reduced miscellaneous Deadweight when fuel, water, and stores are burned out.

Typically, the ballast draft $T_{ballast}$ for an ocean-going vessel in the storm ballast condition is about 60% of $T_{full\ load}$ forward, 80% aft, with a mean draft $T_{ballast}$=70% of the full load draft. Early vessels used solid ballast and then, with the advent of steel ships and mechanical pumps, ships moved to the much more practical water ballast stored in various ballast tanks. The water ballast in these tanks or the residual water and sediment in empty ballast tanks is today the principal vector for the introduction of nonindigenous aquatic species from one environment to another.

By making a complete change in thinking according to the present invention, a ship can also achieve its desired ballast drafts by changing the volume of the watertight hull in the light (no cargo) condition; i.e., reducing the buoyancy rather than adding weight. Again, symbolically this becomes, $$W'=W_{LS}+W_{miscDWT}'=\Delta'(T_{ballast})$$

where Δ=buoyancy of a reduced volume hull form, a function of draft T.

The external portion of the hull around the cargo carrying portion of the ship below the desired ballast waterline ($T_{ballast}$) can be designed to include a group of structural trunks running the full length of the cargo hold. In ballast operations, these trunks can be opened to the sea with an intake opening at the bow and a discharge opening at the stern. Thus, these trunks can be flooded. This can reduce the watertight volume and buoyancy of the hull (to Δ') in the ballast condition. The ship can then achieve its desired ballast drafts. During operation, there is a positive hull surface pressure differential between the bow and the stern regions of a ship. With this positive pressure drop between the bow and the stern, the trunks experience a low velocity flow during the entire ballast voyage. With flow in these trunks, the water in the trunks can always be "local" water virtually eliminating the possibility of the introduction of nonindigenous aquatic species into the Great Lakes and other coastal environments. When loading cargo, these trunks can be isolated from the sea by valves and pumped dry using current ballast pumps.

The overall concept of this ballast condition reduced volume or "ballast-free-ship" will now be described in more detail using as an example a Seaway-size bulk carrier. These vessels comprise over 70% of the ocean-going vessels that enter and put at risk the Great Lakes each year. Typical characteristics for an ocean-going Seaway-size bulk carrier are shown in Table 1. These ships typically enter the Great Lakes loaded with sheet metal or other manufactured products (the NOBOB or No Ballast On Board vessel) or empty (the BOB or Ballast On Board vessel) and return through the Seaway carrying grain from the head of the lakes.

TABLE 1

Characteristics of a Typical Seaway-Size Bulk carrier

| Characteristic | | Typical Value |
|---|---|---|
| Length overall | LOA | 222.5 m |
| Beam | B | 22.86 m |
| Depth | D | 13.1 m |
| Design draft | T | 8.0 m |
| Full Load Displacement | Δ | 34,200 tonnes |
| Cargo capacity | $DWT_c = W_{cargo}$ | 26,000 tonnes |
| Winter ballast mean draft | $T_{ballast}$ | 5.6 m |
| Winter ballast capacity | $W_{ballast}$ | 14,920 tonnes |

To provide a reduced hull volume in the ballast condition, the region of the hull around the cargo holds can be arranged into structural trunks as shown in FIG. 1. During light conditions, these trunks can be opened to the sea to reduce the buoyancy of the hull. These structural trunks are entirely below the ballast waterline as shown. To get the vessel as outlined in Table 1 down to the required winter storm ballast drafts, the innerbottom of the ship is raised above that now typically used. This affects grain cargo volume and raises the cargo center of gravity. This requires special consideration and evaluation in the vessel design.

Figure 2:
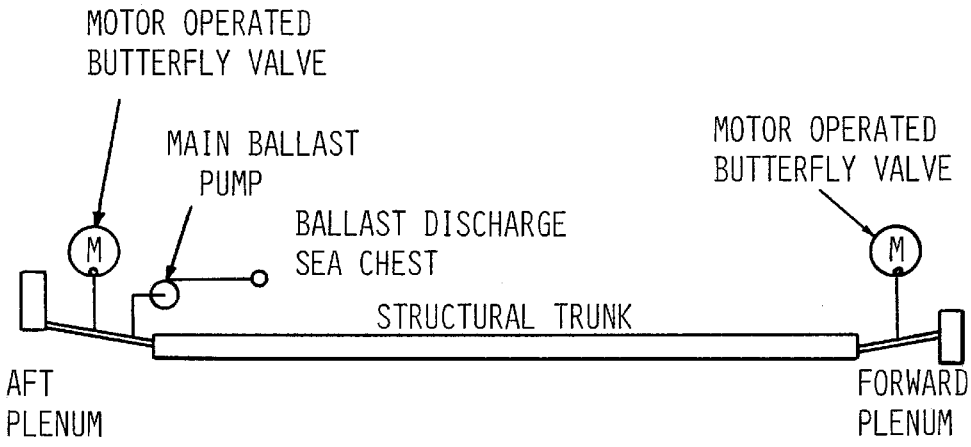
FIG. 2 is a schematic longitudinal cross-section through a ballast trunk according to the present invention.

During operation, as noted above, there is a positive hull surface pressure differential between the bow and the stern regions of a ship. This pressure differential creates a continuous flow through the trunks when the ship is in motion. A longitudinal section through one ballast trunk is shown schematically in FIG. 2. The trunks are connected by piping to a plenum extending across the ship at the bow in the region of high pressure. The trunks are connected by piping to a second plenum extending across the stern above the propeller shaft in the region of low pressure. Motor-operated butterfly valves are used to open and close these connections. The plena are continuously flooded through apertures or passages in the normal hull surface. When the vessel needs its full buoyancy, the valves are closed. With these valves closed, the trunks are pumped dry as in current ballast tank operations.

It is believed that research on model ships will prove the concept of the present invention that there will be adequate pressure differential between the bow and the stern of a typical ship to produce a continuous flow through the trunks when the trunks are flooded and the ship is at design speed. This flow ensures that the trunks are always full of "local water" and, thus, not transporting nonindigenous aquatic species over long distances. To address this question, a design according to the present invention as outlined in FIG. 2 was analyzed using typical marine engineering design methods. A suitable design objective is that the water in the trunk can be replaced with new "local" water in about one hour. Higher flow rates can result in a greater increase in the resistance of the ship requiring more propulsion power and, thus, at some level can become undesirable.

There are two theoretical limits for the flow-through exchange of the fluid in a tank or trunk. If there is no mixing of the two fluids (plug flow), it will only be necessary to move a quantity of water equal to one volume of the trunk for there to be complete replacement or exchange. At the other limit where there is always perfect mixing, the concentration in the tank $C_O$ at time t is given by, $$(C_O-C_{in})/(C_i-C_{in})=e^{-t/\tau}$$

where $C_i$ is the initial concentration of old water ($C_i$=1.0), $C_{in}$ is the entering concentration of the new water, and $\tau$ is the mean residence time (trunk volume/entering flow rate). If it is assumed that the replacement water contains negligible concentration of the old fluid, then $C_{in}$=0 and eq becomes, $$C_O=C_i e^{-t/\tau}$$

This indicates that after three trunk volumes moved into the trunk, $t=3\tau$, the resulting concentration of old fluid will have dropped to 0.05 or 95% exchange has occurred. In this application, the very long narrow trunk will certainly be closer to plug flow than perfect mixing so plug flow should provide an appropriate model for analysis.

Assuming plug flow and a required trunk exchange every hour, there would have to be a 0.527 meter per second (m/s) flow in the connecting piping at the bow and stern if it were to have a 1 meter diameter. Typical trunks can have about a 3 m by 3 m cross-section so the flow can be much lower in the trunks at only about 0.06 m/s. The required pressure drop from the bow to the stern in this situation was calculated to be about 0.124 pounds per square inch (psi) using standard design methods. Expressed in terms of the change in the typical nondimensional pressure coefficient.

$$\Delta C_P=(P_{bow}-P_{stern})/(\rho V^2/2)=0.033$$

or only 3.3% of the stagnation pressure at the ship speed of 14 knots ($C_P$=1.0). Thus, the present invention appears to be quite feasible. Stagnation pressure at bow at 14 knots is 3.76 psi in fresh water at 15 C.

This proof of concept check can be carried one step further by looking at experimental data from the literature. Series 60 is a model of a standard single-screw commercial type hull form used throughout marine hydrodynamics research and design. Model-scale hull surface pressure measurements are available in the literature for a Series 60, block coefficient $C_B$=0.60 hull. This data can help provide insight and additional proof of concept here. Typical bulk carriers are much fuller forms with $C_B$ closer to 0.80 or even 0.85. These fuller hulls should have higher positive pressures at the bow and lower low pressures at the stern than the finer $C_B$=0.60 hull. Thus, the published data will provide a conservative comparison for this purpose. There is one important exception, which is at the stern, the region of low pressure is heavily influenced by the location of the flow separation region at the aft end of the hull. At model scale, this will be much larger than at full scale so care is needed in considering this information and in conducting model scale testing.

Figure 3:
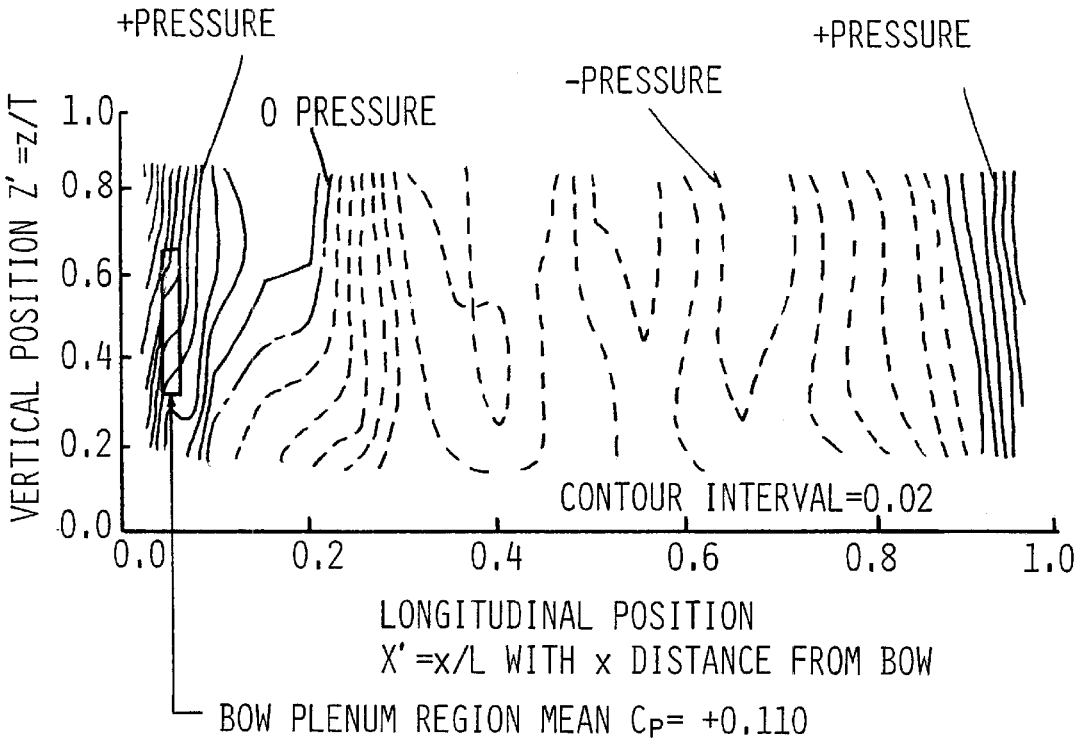
FIG. 3 is a graph of vertical position versus longitudinal position illustrating a pressure coefficient map at a bow of a Series 60 hull.

Previously published research has tested a Series 60 $C_B$=0.60 hull at its design draft and presented the hull surface pressure coefficient map as adapted in FIG. 3. The location at the bow of the inlet plenum can be at about Station 1 (of 20) or at a location about x/L=0.05 from the bow and roughly between the 0.2 and 0.4 design waterline (DWL). This approximate region is shown on FIG. 3. Since the bow ballast draft would only be about 60% of the design draft tested, this region is shown at 0.2/0.6=0.333 to 0.4/0.6=0.67 draft in FIG. 3. In this data, it is shown that the mean pressure coefficient would be about $C_P$=+0.11 at this location.

Figure 4:
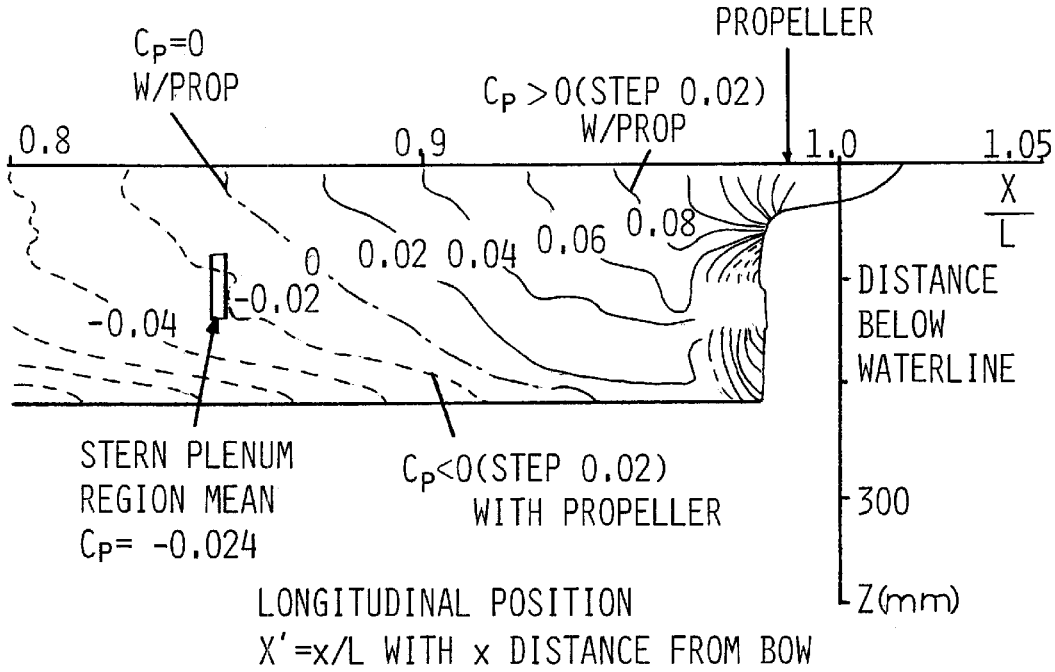
FIG. 4 is a graph of longitudinal distance versus distance below water line for a scale model illustrating a pressure coefficient map at a stern of a Series 60 hull with propeller.

The previously published research also presented experimental data for the Series 60 $C_B$=0.60 hull surface pressure coefficient map at the stern with the propeller operating. This data is adapted in FIG. 4. The location at the stern of the outlet plenum would be above the propeller shaft at about Station 17 (of 20) or at a location about x/L=0.85 from the bow and roughly between the 0.4 and the 0.6 design waterline (DWL). This region is shown on FIG. 4 where it is shown that the mean pressure coefficient would be about $C_P$=−0.024 at this location.

From the Series 60 experiments, the total available differential pressure between the bow plenum and the stern plenum, expressed as a ACE, can then be estimated to be about $\Delta C_P$=0.110−(−0.024)=0.134. Recalling that $\Delta C_P$=0.033 was needed to drive enough flow to change the water in the ballast trunks once per hour, there would appear to be adequate pressure drop to make the concept according to the present invention work. It is believed that the present invention can be competitive economically with other ballast management alternatives.

It is believed that the present invention provides a ship that can be designed, built, and operated using the ballast free concept at a Required Freight Rate and level of safety that equals or exceeds that of a comparable ship using other ballast management alternatives. The present invention can be demonstrated through a combination of design, design analyses, Computational Fluid Dynamics (CFD) computations, and finally model-scale experiments in the University of Michigan Marine Hydrodynamics Laboratory. While the present invention appears to be reasonable and technically feasible, research will confirm that this change in the overall design of ships will actually be physically and economically feasible. The present invention provides a technically sound way to design these ships so that the ships do not transport ballast or sediments from one point to another and essentially operate ballast-free. Research according to the present invention will confirm the key technical and cost issues related to this new concept.

The effect of the flow diversion through the hull on the resistance and propulsion of the ship according to the present invention can be assessed using a combination of analyses, Computational Fluid Dynamics (CFD) computations, and model-scale towing tank experiments. The apertures or passages leading to the plena in the hull can add to the frictional drag of the ship. Form drag is the integral of the axial component of the pressure distribution on the wetted hull surface. The removal of water at the bow and the return of this water in the low pressure region at the stern of the ship can result in a significant reduction of the form drag of the ship. This is difficult to assess because this is highly dependent on the separation region at the stern of the ship, which is very hard to determine from either current CFD computations or model-scale testing. The introduction of the trunk discharge into the low flow region in the upper part of the propeller disk can tend to provide more uniform operating conditions for the propeller and this typically results in improved propulsive efficiency. The net effect of these two issues, the net resistance change and the potential propulsive efficiency improvement, may actually result with careful design in an improvement, or at least an acceptable increase in propulsion cost. CFD can be used to assess the pressure distribution over the hull with the propeller operating in the ballast draft condition. Either the ShipFlow code from Chalmers University in Sweden or the UNCLE code from the Computational Fluid Dynamics Laboratory at Mississippi State University can be used for these analyses. Pressure predictions at the bow of the vessel should be reliable; pressure predictions at the stern and overall drag predictions will have to be evaluated very carefully as these are major challenges to the current state-of-the-art in CFD.

Scale model resistance and propulsion tests can be conducted to complement and provide comparison with the CFD computations. An existing fiberglass model can be located. The thin wall fiberglass construction of the model can permit easy modification of the model to include the inlet and outlet plena and transfer paths. The vessel can be a Lighter Aboard (LASH) Ship with waterline length of 247.9 m and block coefficient $C_B$=0.64. This block coefficient is lower than expected on a Seaway-size bulk carrier, but if the CFD and testing are performed for the same vessel lines, a meaningful comparison for purposes of confirming the present invention is possible. The model can be a large (6.0 m) propulsion test model to minimize difficulties with scale effects, but the scale effects can still be a significant issue to consider. The flow through the ballast trunks can be properly scaled for tests to be run with and without the plena and ballast trunks in operation.

A structural design for the ballast-free ship according to the present invention can provide equivalent structural effectiveness at a comparable cost. With particular consideration of design for production, it is believed that the modified structural design can be developed to meet current requirements without adding to the expected construction costs. Local Finite Element Method (FEM) analyses can be performed as needed to validate the candidate design. The inlet and outlet plena, ballast piping, and ballast system controls within a typical overall ship and engine room arrangement according to the present invention can be developed to establish that the concept is feasible at acceptable cost. The routing of multiple 1 meter (m) diameter ballast lines around and through the aft located engine room on the ship will be confirmed.

The cargo arrangements that can provide the same grain cargo capacity as existing vessels can be developed. Since the innerbottom of the vessel will have to be raised as shown in FIG. 1 to provide adequate ballast trunk volume below the ballast waterline, the cargo volume will likely be reduced without special consideration. This is not a problem with heavy bulk cargoes, but the grain stowage factor ($m^3$/t) is high requiring care and detailed design to ensure that the grain cargo capacity of the vessel is not compromised. It may be necessary to extend the cargo hatches upward or even add depth to the hull to maintain grain capacity. The higher innerbottom will also raise the center of gravity of the cargo requiring careful consideration of its impact on the transverse stability of the vessel. For the design developed according to the present invention, the transverse stability can be assessed to ensure that the higher cargo center of gravity will not compromise ship stability. Stability can be evaluated for the various operating conditions.

Ship motions at sea reflecting a higher ballast condition metacentric height $GM_T$ and a higher cargo center of gravity can be evaluated. Motions and structural loads in a seaway can be evaluated for the ballast-free ship design. Since the ballast trunks can be lower than the typical ballast tank weight, the ballast condition transverse metacentric height $GM_T$ can be even higher than normal. This can lead to a reduction in the roll natural period and result in a rough ride in the ballast condition. This situation needs to be evaluated carefully with appropriate mitigation included if the motions will be problematic.

The damage survival capability with the proposed ship subdivision arrangement according to the present invention can be assessed relative to the current probabilistic IMO standards to verify at least equivalent safety with the longitudinal trunks. A typical bulk carrier can have traverse subdivision bulkheads between the cargo holds and these can extend to the shell through the surrounding ballast tanks. In the ballast-free ship, the present invention can result in transverse subdivision only between the cargo holds. Within the surrounding double hull, there can only be longitudinal subdivision between the trunks. This is an exceptional arrangement that requires careful analysis to ensure that safety is not compromised. Fortunately, the current probabilistic damage stability standards make no assumption about the subdivision concept and arrangement and provide a detailed protocol by which to calculate the probability of survival from potential collisions and groundings. This can be applied to the ballast-free concept according to the present invention to ensure that a design can be developed that provides an equivalent level of safety.

Ship design alternatives are typically evaluated by a measure of merit such as the Required Freight Rate. This approach recognizes the time value of capital and provides the price per unit cargo that is needed to break even considering the economic life of the vessel and a company's required rate of return on investment. It combines an annualized estimate of the ship construction capital outlay and estimated operating costs to provide a valid economic comparison between the ballast-free ship and existing ships with other ballast management options. This can require the detailed estimate of at least the changes in capital and operating costs between the two concepts.

The present invention essentially eliminates the ballast condition transfer of nonindigenous aquatic species. However, with only a slow flow in the ballast trunks, as needed to avoid a large ship resistance penalty, there remains the possibility of the development of sediments in the trunks over time and the transfer via that mode. Special consideration can be given to this issue and means to keep the trunks clean and free of sediment can be developed. This goal can ensure maximum cargo capacity of draft-limited bulk carriers over time.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A ballast system for a ship surrounded by water, the ship having a bow and a stern, the ballast system comprising:

at least one trunk positioned below the waterline and having an intake opening adjacent the bow and a discharge opening adjacent the stern of the ship; and means for directly communicating the intake and discharge openings of each trunk with water surrounding the ship when the ship is in a light cargo condition, wherein the communicating means includes each trunk having a first valve adjacent the intake opening and a second valve adjacent the discharge opening, each valve moveable between an opened position and a closed position to place the trunk in communication with the water surrounding the ship when in the opened position and to isolate the trunk from communication with the water surrounding the ship when in the closed position.

2. The system of claim 1 further comprising:

a pump for emptying water from each trunk when the first and second valves are in the closed position.

3. The system of claim 1 further comprising:

a water pressure differential between the bow and stern of the ship when the ship is in motion to create fluid flow in each trunk sufficient to exchange an entire volume of water within each trunk in at least approximately one hour.

4. The system of claim 1 wherein the communicating means further comprises:

a watertight volume of the ship changes as each trunk is brought into communication with water surrounding the ship.

5. The system of claim 1 wherein the communicating means further comprises:

a buoyancy of the ship changes as each trunk is bought into communication with water surrounding the ship.

6. The system of claim 1 further comprising:

a low velocity flow through each trunk occurs during forward motion of the ship.

7. A ballast system for a ship surrounded by water, the ship having a bow and a stern, the ballast system comprising:

at least one trunk positioned below the waterline and having an intake opening adjacent the bow and a discharge opening adjacent the stern of the ship;

means for directly communicating the intake and discharge openings of each trunk with water surrounding the ship when the ship is in a light cargo condition; and a forward plenum connecting each trunk in fluid communication with water surrounding the bow of the ship.

8. A ballast system for a ship surrounded by water, the ship having a bow and a stern, the ballast system comprising:

at least one trunk positioned below the waterline and having an intake opening adjacent the bow and a discharge opening adjacent the stern of the ship;

means for directly communicating the intake and discharge openings of each trunk with water surrounding the ship when the ship is in a light cargo condition; and a rearward plenum connecting each trunk in fluid communication with water surrounding the stern of the ship.

9. The system of claim 8 wherein the rearward plenum extends across the stern of the ship above the propeller shaft.

10. A method for ballasting a ship surrounded by water, the ship having a bow and a stern, the method comprising the steps of:

providing at least one trunk positioned below the waterline and having an intake opening adjacent the bow and a discharge opening adjacent the stern of the ship; and directly communicating the intake and discharge openings of each trunk with water surrounding the ship when the ship is in a light cargo condition, wherein the communicating step includes the steps of providing each trunk having a first valve adjacent the intake opening and a second valve adjacent the discharge opening, and moving each valve between an opened position and a closed position to place each trunk in communication with the water surrounding the ship when in the opened position and to isolate each trunk from communication with the water surrounding the ship when in the closed position.

11. The method of claim 10 further comprising of step of:

emptying water from each trunk with a pump when the first and second valves are in the closed position.

12. The method of claim 10 further comprising the step of:

exchanging an entire volume of water within each trunk with a water pressure differential existing between the bow and stern of the ship when the ship is in motion sufficient to create fluid flow in each trunk.

13. The method of claim 10 wherein the communicating step further comprises the step of:

changing a watertight volume of the ship as each trunk is brought into communication with water surrounding the ship.

14. The method of claim 10 wherein the communicating step further comprises the step of:

changing a buoyancy of the ship as each trunk is bought into communication with water surrounding the ship.

15. The method of claim 10 further comprising the step of:

creating a low velocity flow through each trunk during forward motion of the ship.

16. A method for ballasting a ship surrounded by water, the ship having a bow and a stern, the method comprising the steps of:

providing at least one trunk positioned below the waterline and having an intake opening adjacent the bow and a discharge opening adjacent the stern of the ship;

directly communicating the intake and discharge openings of each trunk with water surrounding the ship when the ship is in a light cargo condition; and connecting each trunk in fluid communication with water surrounding the bow of the ship with a forward plenum.

17. A method for ballasting a ship surrounded by water, the ship having a bow and a stern, the method comprising the steps of:

providing at least one trunk positioned below the waterline and having an intake opening adjacent the bow and a discharge opening adjacent the stern of the ship;

directly communicating the intake and discharge openings of each trunk with water surrounding the ship when the ship is in a light cargo condition; and connecting each trunk in fluid communication with water surrounding the stern of the ship with a rearward plenum.

18. The method of claim 17 wherein the rearward plenum extends across the stern of the ship above the propeller shaft.

19. A ballast system for a ship surrounded by water, the ship having a bow and a stern, the ballast system comprising:

at least one trunk positioned below the waterline and having an intake opening adjacent the bow and a discharge opening adjacent the stern of the ship; and at least one intake flow control valve and at least one discharge flow control valve, each valve operable between opened and closed positions selectively communicating each trunk with water surrounding the ship when the ship is in a light cargo condition and allowing flow of water through each corresponding trunk in response to movement of the ship through the water when in an opened position.

20. The system of claim 19 further comprising:

a forward plenum connecting each trunk in fluid communication with water surrounding the bow of the ship; and a rearward plenum connecting each trunk in fluid communication with water surrounding the stern of the ship.

* * * * *